US008919419B2

(12) United States Patent
Mullet et al.

(10) Patent No.: US 8,919,419 B2
(45) Date of Patent: Dec. 30, 2014

(54) COUNTERBALANCED MOTORIZED SHADE ROLL SYSTEM AND METHOD

(75) Inventors: Willis Jay Mullet, Gulf Breeze, FL (US); Richard Scott Hand, Pace, FL (US)

(73) Assignee: Qmotion Incorporated, Pensacola, FL (US)

( * ) Notice: Subject to any disclaimer, the term of this patent is extended or adjusted under 35 U.S.C. 154(b) by 701 days.

(21) Appl. No.: 12/460,111

(22) Filed: Jul. 14, 2009

(65) Prior Publication Data

US 2010/0269988 A1 Oct. 28, 2010

Related U.S. Application Data

(63) Continuation-in-part of application No. 12/315,596, filed on Dec. 4, 2008.

(51) Int. Cl.
*E06B 9/56* (2006.01)
*E06B 9/62* (2006.01)
*E06B 9/72* (2006.01)

(52) U.S. Cl.
CPC .... *E06B 9/62* (2013.01); *E06B 9/72* (2013.01)
USPC ..... 160/310

(58) Field of Classification Search
USPC ..... 160/191, 192, 318, 189, 310, 311, 312, 160/313, 315
See application file for complete search history.

(56) References Cited

U.S. PATENT DOCUMENTS

| | | | | | |
|---|---|---|---|---|---|
| 1,746,458 | A * | 2/1930 | Bollinger | 160/310 |
| 1,853,704 | A * | 4/1932 | Standow | 160/310 |
| 3,292,453 | A * | 12/1966 | Recknagel | 74/625 |
| 4,171,845 | A * | 10/1979 | Hirsch | 296/97.4 |
| 4,766,941 | A * | 8/1988 | Sloop et al. | 160/241 |
| 5,054,605 | A | 10/1991 | Bavis | |
| 5,133,399 | A | 7/1992 | Hiller et al. | |
| 5,434,487 | A | 7/1995 | Long et al. | |
| 5,482,100 | A | 1/1996 | Kubar | |
| 5,889,377 | A | 3/1999 | Mao | |
| 6,082,433 | A | 7/2000 | Vafaie et al. | |
| 6,144,177 | A | 11/2000 | Mao | |
| 6,201,364 | B1 * | 3/2001 | Will et al. | 318/466 |
| 6,628,029 | B2 * | 9/2003 | Astegno | 310/105 |
| 6,680,594 | B2 * | 1/2004 | Collett et al. | 318/280 |
| 7,237,592 | B2 * | 7/2007 | Arnoux et al. | 160/310 |
| 8,258,993 | B2 * | 9/2012 | Inoue et al. | 341/176 |
| 8,464,776 | B2 * | 6/2013 | Anthoine | 160/310 |
| 8,575,872 | B2 * | 11/2013 | Mullet et al. | 318/255 |
| 8,659,246 | B2 * | 2/2014 | Mullet et al. | 318/255 |
| 8,723,455 | B2 * | 5/2014 | Mullet et al. | 318/34 |
| 2005/0035238 | A1 * | 2/2005 | Fun | 242/381 |
| 2006/0185799 | A1 * | 8/2006 | Kates | 160/5 |
| 2008/0196846 | A1 * | 8/2008 | Glasl | 160/313 |
| 2011/0005694 | A1 * | 1/2011 | Ng | 160/311 |

* cited by examiner

*Primary Examiner* — Katherine Mitchell
*Assistant Examiner* — Johnnie A Shablack
(74) *Attorney, Agent, or Firm* — Zarley Law Firm, P.L.C.

(57) ABSTRACT

In a window covering system with a shade roll, a counterbalanced motorized shade roll system includes a shade roll with a hollow interior connected with a window covering system. A motor is located within the hollow interior. A torsion spring is also located within the hollow interior of the shade roll and the torsion spring is connected with the motor on one end and with the hollow interior on another end. Batteries are also located within the hollow interior of the shade roll opposite from the motor and after the connection of the torsion spring with the hollow interior of the shade roll such that the torsion spring does not surround the batteries.

18 Claims, 5 Drawing Sheets

COUNTERBALANCED MOTORIZED SHADE ROLL SYSTEM AND METHOD

CROSS REFERENCE TO RELATED APPLICATIONS

This application is a Continuation in Part of U.S. patent application Ser. No. 12/315,596 filed Dec. 4, 2008 entitled "Removable Battery System and Method". The Applicants hereby claim the benefit of the non-provisional application under 35 U.S.C. §120. The entire content of the non-provisional application is incorporated herein by this reference.

FIELD OF THE INVENTION

This invention relates to a counterbalanced motorized shade roll system and method. In particular, in accordance with one embodiment, the invention relates, in a window covering system with a shade roll, to a counterbalanced motorized shade roll system including a shade roll with a hollow interior connected with a window covering system. A motor is located within the hollow interior. A torsion spring is also located within the hollow interior of the shade roll and the torsion spring is connected with the motor on one end and with the hollow interior on another end. Batteries are also located within the hollow interior of the shade roll opposite from the motor and after the connection of the torsion spring with the hollow interior of the shade roll such that the torsion spring does not surround the batteries.

BACKGROUND OF THE INVENTION

Prior art shade and curtain devices designed to selectively cover and uncover openings exist in an astounding number of forms. As used herein, the term "shade" and "curtain" are used in their common manner and given their common meaning. Thus, for the purposes of providing background, but not by way of limitation, "shade" and "curtain" include window shades and curtains used to selectively cover and uncover windows and other openings in a structure. These prior art devices often require additional components such as guides, cables and pulleys to ensure the shade moves to the desired locations.

Further, prior art window covering systems are bulky, complicated devices more or less by necessity because they must include enough shade to cover the length and breadth of a window and they must be sturdy enough to support all of the related operational parts. As a result, many if not most of these prior art window covering systems, for example only, are custom made or made to a selected assortment of lengths. This variety is useful but not completely satisfactory since window and door sizes are not uniformly standard and a user may have multiple numbers of different sized openings to cover. The prior art devices are not adjustable or adaptable to different sizes themselves.

Further, prior art curtain and shade systems have of necessity been robust and large when the opening was large because of the weight of the shade that must be manipulated. A persistent and common problem is "drift". Drift is what happens when the system manipulating a shade is not strong enough to prevent the curtain from moving from a selected position. If the system is not strong enough, the weight of the shade will drag it down. Prior art solutions include locks, brakes or use of a motor to hold the shade in place. Every added element adds weight, complexity and bulk.

Further, as the weight and bulk increase, the size of other elements increases as well. Motorized systems then become large, noisy systems. The connection of the motor to a power source becomes an intrusive and ugly addition that has prompted development of battery operated systems that do not require external connection to a power source. Likewise, however, prior art battery operated systems include battery packs that are unsightly as well and do not address the motor noise problem in any significant manner.

By way of continued discussion, U.S. Pat. No. 5,054,605 to Bavis discloses a conveyor system for conveying items and including a carrier for such items to be moved between at least two spaced-apart stations and a first guide track extending between the spaced apart stations. A flexible drive tape having a leading edge and a trailing edge is reciprocally mounted within the first guide track for moving the carrier between the spaced-apart stations, wherein the flexible drive tape is attached to the carrier adjacent the leading edge by a plurality of connectors. At least one of the connectors allows controlled relative movement between the tape and the carrier. A toothed cog wheel is preferably provided around a substantial portion of the periphery of which the drive tape is wound within a cog surround which at least partly encloses the cog wheel and the wound drive tape. The surround further includes a pair of tape peeler tips oppositely disposed adjacent the cog wheel to peel the tape away from the cog wheel as the wheel is rotated in use. The carrier is supported adjacent the first guide track as it is conveyed by the drive tape between spaced apart stations, and a second guide track is provided for receiving the trailing edge of the drive tape. In a preferred embodiment, docking members provide additional support for said carrier at the stations.

U.S. Pat. No. 5,133,399 to Hiller et al. discloses an improved blind unit or shade having no pull cord for raising and lowering the blind members of the blind unit. The lower rail is movable upwardly from the lowermost position thereof when an upwardly directed force is applied to cord structure coupled with the blind members and the lower rail. When the lower rail moves progressively upwardly or downwardly with reference to the head rail above the blind members, the lower rail supports a progressively greater or lesser number of blind members. A variable, upwardly directed force is applied to the cord structure with the force being substantially equivalent at all times to the combined weights of the lower rail and the blind members supported on the lower rail when the lower rail is above its lowermost operative position. The force applying means, in one embodiment includes at least one conical member coupled to a constant force spring. In another embodiment, the force applying means includes a variable force leaf spring.

U.S. Pat. No. 5,434,487 to Long et al. discloses a power operating system for a vehicle door includes a motor operable to power the door open or closed. When a manual movement of the door a predetermined distance is detected while the motor is inactive, the motor is energized so as to move the door in the direction of the detected movement to complete the manually initiated door movement. This patent is directed at a horizontal sliding door such that there is no need for counterbalancing. There is no separation between manual movements to establish a new position of the door. Any manual movement beyond a predetermined amount will activate the motor to power the door in either the fully open or the fully closed position before the motor will disengage.

U.S. Pat. No. 5,482,100 to Kubar discloses a cordless, balanced Venetian blind or shade with a constant variable spring motor includes conventional window covering components without the outside hanging lifting cords or cord locking mechanisms. One or more constant variable force spring motors are employed, preferably comprising springs which vary in thickness or in width along their length as they are wound around storage drums. A cord spool, in the preferred embodiment, is coupled to one of the spring drums to serve to wind the cords to cause the blind to be raised or lowered, simply by manipulation of the bottom bar of the blind system. Due to the difference in thickness or width of the spring, the system compensates for the increasing weight on the cords as the window covering is raised and for the decreasing weight as it is lowered.

U.S. Pat. No. 5,889,377 to Mao discloses a drapery actuator to open and close draperies and the like, comprising a housing and a drive pulley supported by the housing to engage a drapery cord. A motor is supported by the housing for reversibility rotating the drive pulley to move the drapery cord between a first extreme position and a second extreme position. A first electrical switch is operatively connected to the motor and a second electrical switch is also operatively connected to the motor. Switch actuator cooperate with the drive pulley such that the first electrical switch is actuated when said drive pulley moves the drapery cord to the first extreme position and the second electrical switch is actuated when the drive pulley is reversibly rotated by the motor to move the drapery cord to the second extreme position whereby when the drapery cord is in the first extreme position and the second extreme position the motor is deactivated and the drapery cord ceases moving. This is a conventional motor operated system that employs switches that can become damaged or deteriorate over a period of time.

U.S. Pat. No. 6,082,433 to Vafaie et al. discloses a flexible curtain rollup door that is driven between open and closed positions by an adjustable frequency AC electric drive motor including a controller which is operable to accelerate and decelerate the motor by supplying AC electrical power at variable frequencies over a predetermined time period and for operating the motor at selected speeds during a continuous run phase of operation. A programmable logic controller (PLC) is operably connected to the controller for the drive motor and is operable to receive signals from upper and lower door position sensors, door bottom edge bar breakout sensors, a door bottom edge bar contact sensor, area sensors on one or both sides of the door for detecting the presence of an object within certain areas adjacent the door opening and manually operable switches to control opening and closing movements of the door. A position sensor is connected to the motor and generates signals correlated with motor and curtain roll drum revolutions to provide backup door position signals. An operating setup procedure includes teaching the PLC signals corresponding to the open and closed positions of the door to provide backup motor shutoff signals in the event that the door position or bottom bar breakout sensors fails to effect shutoff of the drive motor.

U.S. Pat. No. 6,144,177 to Mao discloses a drapery actuator to open and close draperies, comprising housing and a drive pulley supported by the housing to engage a drapery cord coupled to a drape. A motor, typically a D.C. motor, is supported by the housing for providing torque to reversibly rotate the drive pulley to move the drapery cord between a first extreme (typically closed) position and a second extreme (typically open) position. A first electrical switch operatively connected to the motor functions as a cut-out switch and reversing switch to stop the motor from continued turning in a given direction and thereafter switching polarity, to allow the motor to turn in an opposite direction when the switch is re-activated. A torque-activated mechanism is provided, adapted to actuate the first electrical switch when the drive pulley moves the drapery cord to the first position, and is further adapted to actuate the first electrical switch when the drive pulley is reversibly rotated by the motor to move the drapery cord to the second position.

Thus, there is a need in the art for a system for covering openings, in particular a window covering system for example but not by limitation, that is not bulky, that is adjustable to fit any required opening, that controls the shade such that drift is eliminated, that is quiet in operation and that is operated by batteries that are not exposed such that no external power source connection is required.

It, therefore, is an object of the invention to provide a window covering system that is not bulky and is adjustable to fit any required opening but that is strong enough to control the shade such that drift is eliminated, that is quiet in operation and that is operated by batteries that are not exposed such that no external power source connection is required.

SUMMARY OF THE INVENTION

Accordingly, in a window covering system with a shade roll, the counterbalanced motorized shade roll system of the present invention, according to one embodiment, includes a shade roll with a hollow interior connected with a window covering system. A motor is located within the hollow interior. A torsion spring is also located within the shade roll where the torsion spring is connected with the motor on one end and with the hollow interior on another end. Batteries are also located within the hollow interior of the shade roll opposite from the motor and after the connection of the torsion spring with the hollow interior of the shade roll such that the torsion spring does not surround the batteries.

As used herein, the term "torsion spring" is used in its common and accepted manner to describe a device that deforms under stress and seeks to return to a base or starting position. Torsion springs are well known and are not described more fully hereafter. Nonetheless, as described herein, the Applicants have selected a torsion spring system so as to enable the system to be "counterbalanced". In combination, as more fully described and illustrated, the torsion spring enables a window covering system that is easy to position and that does not require guides, pulleys and cables.

According to another aspect of the invention, a reduction gear is connected with the motor. In one aspect, the reduction gear is a two stage planetary reduction gear.

In a further aspect, a liner is provided in the hollow interior of the shade roll as a noise reduction device and/or as a sliding surface for moving parts such as the torsion spring. In one aspect the liner surrounds the torsion spring as a noise dampener and in another aspect, the torsion spring surrounds the liner and the liner provides lubricity to the torsion spring.

In one aspect, the torsion spring at least partially surrounds the motor. This is useful in that it enables the torsion spring to take up less space and, thus, creates more space for batteries, for example only.

In one aspect, the motor is connected with a drive shaft and the drive shaft is connected with a drive cone connected within the hollow interior. In another aspect, the torsion spring is connected on one end with the drive cone. In one aspect, the drive cone is conformed to surround a length of the drive shaft and the drive cone is moveable along the length of the drive shaft.

According to another embodiment of the invention, in a window covering system with a shade roll, a counterbalanced motorized shade roll system includes a shade roll with a hollow interior connected with a window covering system. A motor is located within the hollow interior and connected with the window covering system. A reduction gear is connected with the motor. A drive shaft is connected with the motor and the drive shaft is connected with a drive cone connected within the hollow interior. A torsion spring is located within the shade roll and the torsion spring is connected with the motor on one end and with the hollow interior on another end. Batteries are located within the hollow interior of the shade roll opposite from the motor and after the connection of the torsion spring with the hollow interior of the shade roll such that the torsion spring does not surround the batteries.

In one aspect, the reduction gear is a two stage planetary reduction gear. In another aspect, a liner is located in the hollow interior of the shade roll. In one aspect, the liner surrounds the torsion spring. In a further aspect, the liner includes a first liner that surrounds the torsion spring and a second liner which the torsion spring surrounds such that the torsion spring is located between the first liner and the second liner.

In another aspect, the torsion spring at least partially surrounds the motor. In a further aspect, the torsion spring is connected on one end with the drive cone.

According to another embodiment of the invention, in a window covering system with a shade roll, a counterbalanced motorized shade roll method includes the steps of providing a shade roll with a hollow interior connected with a window covering system; a motor located within the hollow interior and connected with the window covering system; a torsion spring within the shade roll where the torsion spring is connected with the motor on one end and with the hollow interior on another end; and batteries located within the hollow interior of the shade roll opposite from the motor and after the connection of the torsion spring with the hollow interior of the shade roll such that the torsion spring does not surround the batteries; and then operating the batteries such that energy from the batteries moves the shade roll.

In one aspect, a reduction gear is connected with the motor. In another aspect, a liner is provided in the hollow interior of the shade roll. In a further aspect, the motor is connected with a drive shaft and the drive shaft is connected with a drive cone connected within the hollow interior.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
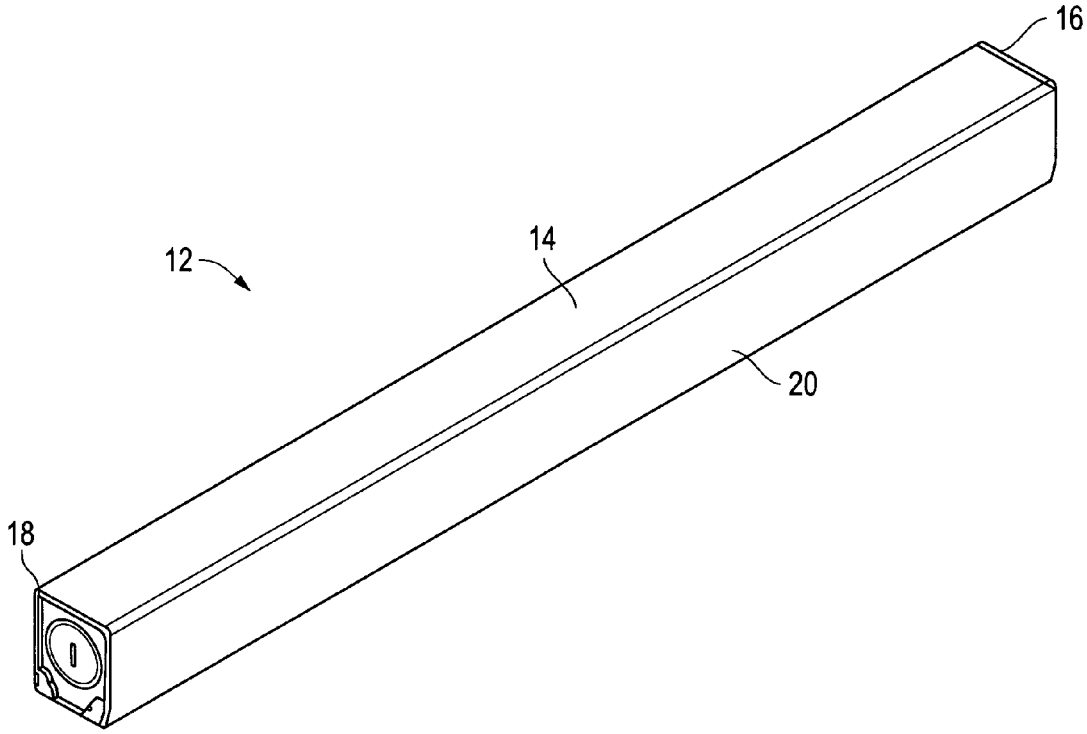
FIG. 1 is a perspective view of a window covering system according to one embodiment of the counterbalanced motorized shade roll system of the present invention.
Figure 2:
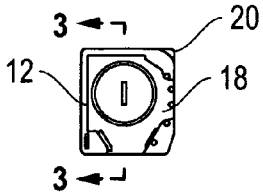
FIG. 2 is an end view of the window covering system of FIG. 1.

The preferred embodiment of the present invention is illustrated by way of example in FIGS. 1-9. With specific reference to FIGS. 1, 2, 3, and 4 the counterbalanced motorized shade roll system 10 of the present invention includes a window covering system 12. Window covering system 12, for purposes of example, includes a mounting bracket 14, end caps 16 and 18 and front cover 20.

Figure 3:
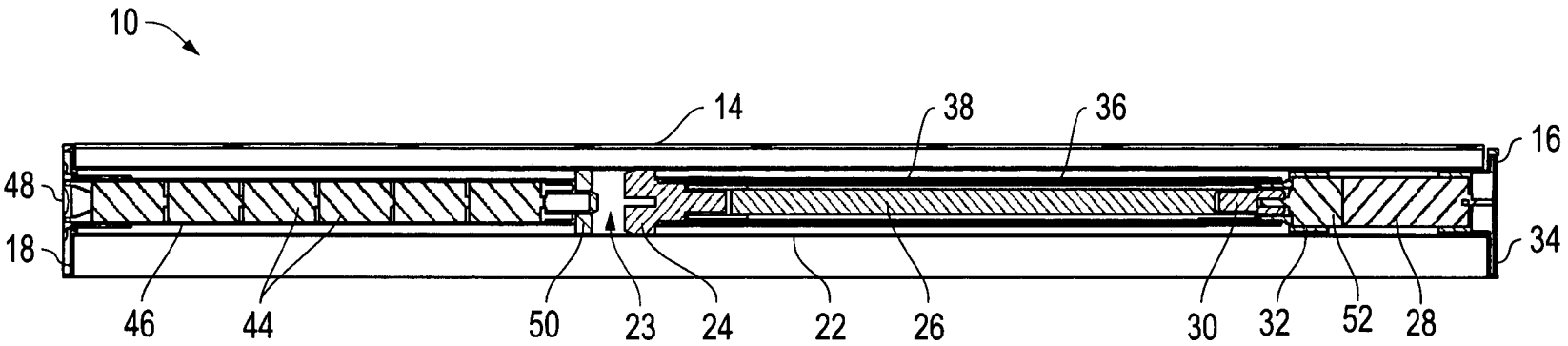
FIG. 3 is a side sectional view of the counterbalanced motorized shade roll system according to one embodiment.
Figure 4:
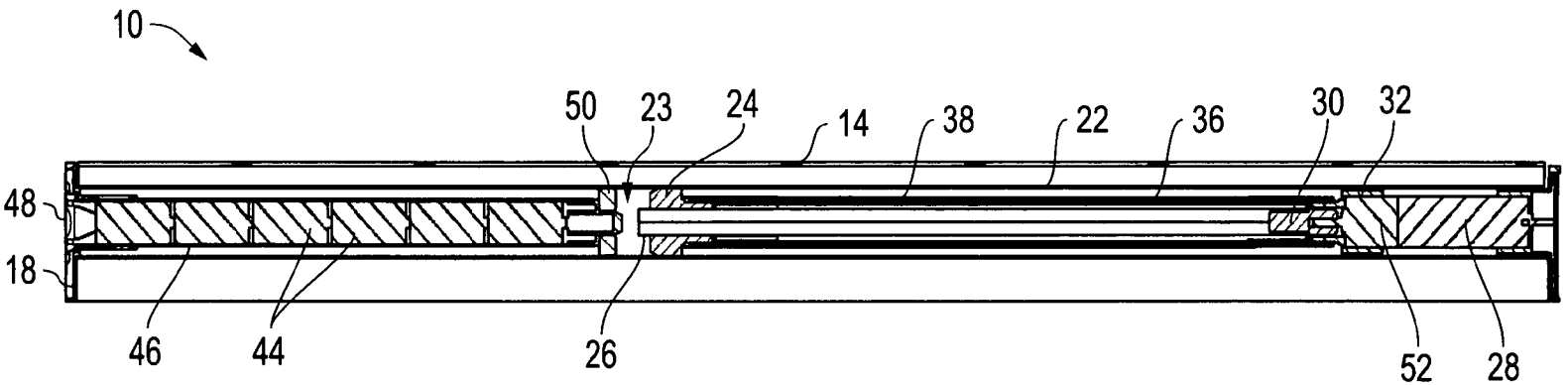
FIG. 4 is a side sectional view of the counterbalanced motorized shade roll system according to another embodiment with an extended drive shaft.

Referring specifically to FIGS. 3 and 4, shade roll 22 stores a shade or curtain (not shown) for covering an opening. Shade roll 22 is supported by bearing shoulders of end caps 16 and 18 as shown. Shade roll 22, importantly, for the purposes of the invention, is hollow and includes a hollow interior space 23. Shade roll 22 is driven by drive cone 24 that is driven by drive shaft 26 that is coupled with motor 28 by coupler 30, all of which are located in the hollow interior space 23 of shade roll 22. Motor 28 is secured to the end cap 16 as shown and stationary spring perch 32. A motor controller is located on a printed circuit board (PCB) 34. Torsion spring 36 surrounds drive shaft 26 and is connected to stationary spring perch 32 on one end and drive cone 24 on the other as illustrated.

Counterbalancing of the present invention is achieved by the torsional difference of the torsion spring 36 created by the angular displacement of the drive cone 24 and stationary spring perch 32. That is, activation of motor 28 turns coupler 30 which turns drive shaft 26 which turns drive cone 24 and results in movement of shade roll 22. When a shade is connected with shade roll 22, the shade will be paid out or rolled up depending on the direction of movement of the shade roll 22.

Importantly, Applicants' have determined that the utilization of the heretofore unutilized space, the hollow interior space 23, of shade roll 22 goes a long way to reduce operating noise. The problem of noise, however, continues even with this advance and Applicants' present invention includes, in a preferred embodiment, a liner 38 (more clearly shown in FIGS. 5-8) located within hollow interior space 23. Liner 38 may be made of an ultra high molecular weight polyethylene (UHMWPE) or a high density polyethylene (HDPE) for example only and not by limitation. Liner 38 provides noise reduction when surrounding torsion spring 36 and provides lubricity and support when torsion spring 36 surrounds liner 38. In one embodiment, torsion spring 36 is sandwiched between a first liner 40 and a second liner 42 again as more clearly shown in FIGS. 5-8.

Still referring to FIGS. 3 and 4, batteries 44 are held within battery tube 46 and battery tube 46, with batteries 44 inside, is located within the hollow interior space 23 of shade roll 22. Battery tube 46 makes electrical connection through battery cap 48 to PCB 34 to motor 28. On one end, battery tube 46 is supported by battery tube support 50 located within hollow interior space 23.

Referring specifically to FIG. 3, drive shaft 26 is shown connected on one end with stationary spring perch 32 and on the other end with drive cone 24. In this embodiment, drive shaft 26 is a fixed length and, consequently, no adjustment of its length is easily available in order to accommodate the particular needs of a specific installation. That is, it may be necessary to increase or decrease the length of torsion spring 36 in order to handle heavier or lighter shade systems. While it is possible, and is easier than in prior art systems, the embodiment of FIG. 3 requires the removal of drive shaft 26 and replacement of it with the required size, which may or may not be available.

In the situation where rapid adjustment is a desired feature, FIG. 4 illustrates an embodiment in which drive shaft 26 extends through drive cone 24. That is, drive cone 24 is open in the center and is conformed to surround a length of drive shaft 26. As a result, drive cone 24 may be positioned along the length of drive shaft 26, either closer to stationary perch 32 or farther away from stationary perch 32, for example. In this case, it is a simple matter to adjust the effective length of drive shaft 26, so as to accommodate more or less torsion spring 36, by pressing drive cone 24 further on to or off of drive shaft 26.

Figure 5:
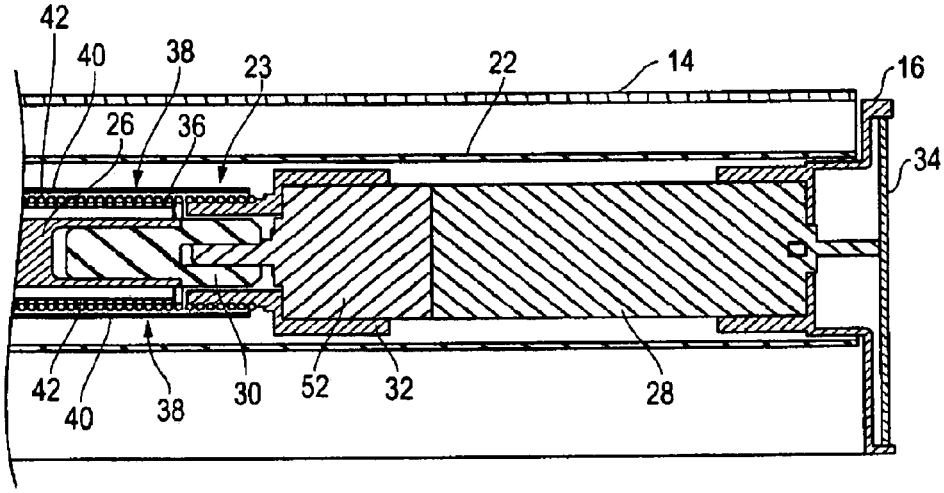
FIG. 5 is a side partial sectional view of the motor end of FIG. 3.
Figure 6:
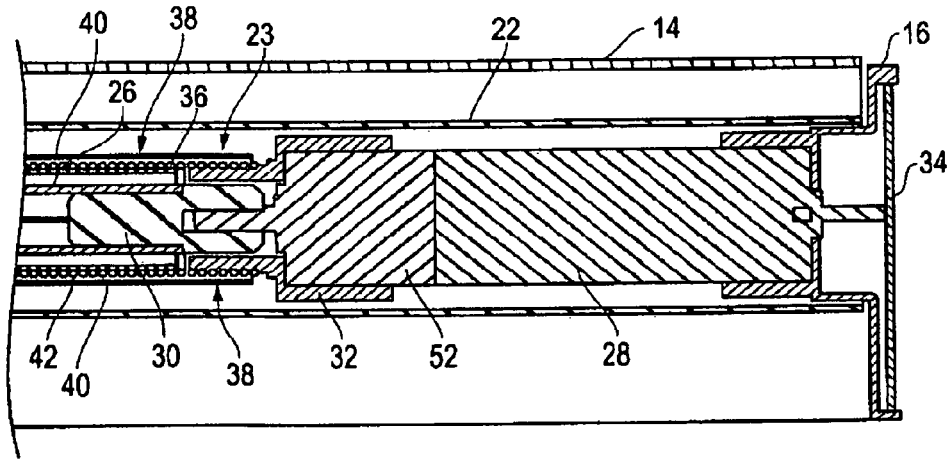
FIG. 6 is a side partial sectional view of the motor end of FIG. 4.

Referring to FIG. 5, a close up of the right hand side of FIG. 3 is shown. As shown, preferably motor 28 includes a reduction gear 52 and preferably reduction gear 52 is a two stage planetary reduction gear reducer as known in the art and not described more fully hereafter. This arrangement allows the motor 28 to be driven by the movement of the shade when a user wants to reposition the shade without using the motor 28. This movement is enabled by the combination of the lower drag, two stage, reduction gear 52 and the counterbalance effect created by the elements of the invention described and illustrated herein. This arrangement is especially effective for use with wider and longer shades and curtains which have thicker material. These heavier curtains are difficult to maintain in place after they cover a majority of the opening. In contrast to prior art systems, the combination of the counterbalance system and the two stage planetary reduction gear 52 eliminates curtain drift after motor 28 is shut off and allows the curtain to be manually adjusted when the motor 28 is off. Applicants' have determined that the counterbalance system enables the use of much quieter two stage planetary reduction gear 52 to prevent curtain drift. When the curtain or shade is lowered manually the tension of pulling down on the curtain tensions torsion spring 36 and moves the reduction gear 52 and the motor shaft of motor 28. When the curtain is raised manually, the reduction of the weight the curtain is exerting on the torsion spring 36 causes the torsion spring 36 to turn the drive cone 24, turning the drive shaft 26 and ultimately the motor 28 and rolling up the curtain until the curtain is released by the user and the weight of the curtain is again counterbalanced by the torsion spring 36.

Figure 7:
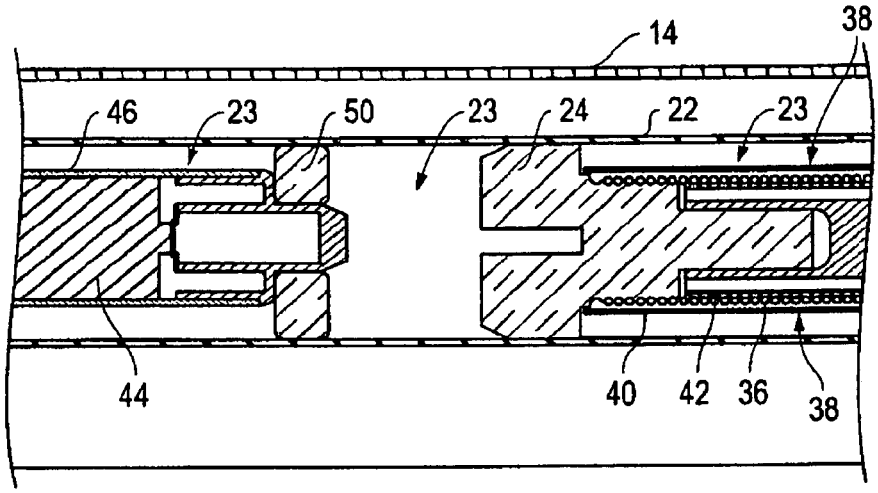
FIG. 7 is a side partial sectional view of the middle section of FIG. 3.
Figure 8:
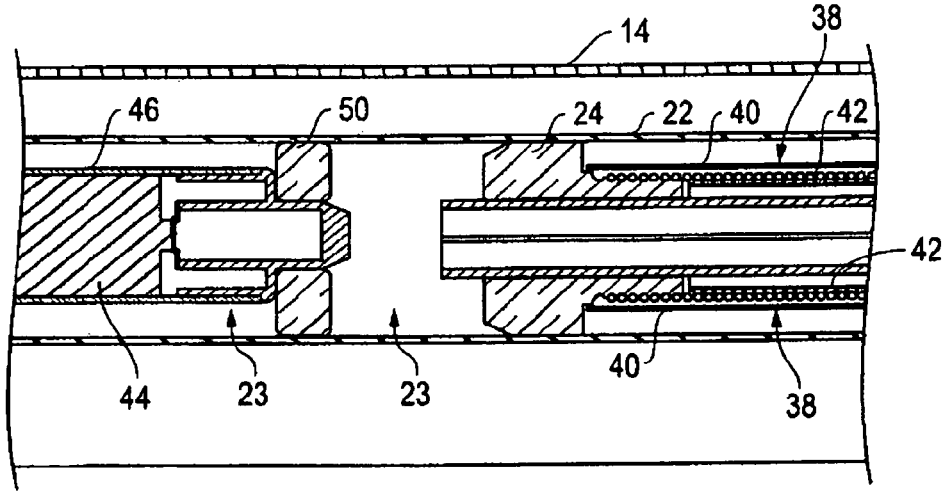
FIG. 8 is a side partial sectional view of the middle section of FIG. 4.

Referring now to FIGS. 7 and 8, the middle of the invention shown in FIGS. 3 and 4 is shown in expanded detail where, as with all the figures, the same numbers are used to identify the same elements in several figures.

Figure 9:
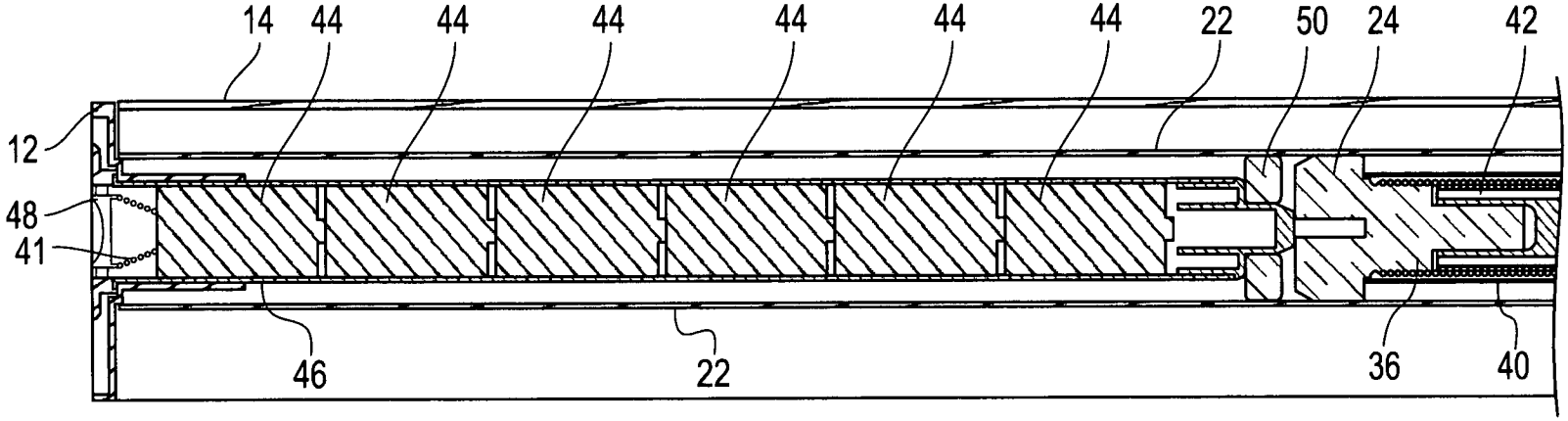
FIG. 9 is a side partial sectional view of the battery end of FIG. 3.

Referring to FIG. 9, the left hand side of FIG. 3 is shown in expanded detail. Importantly, it can be clearly seen that batteries 44, within battery tube 46, are located within the hollow interior space 23 of shade roll 22 opposite from motor 28 and after the connection of the torsion spring 36 with shade roll 22 by means of drive cone 24. Further, according to this invention torsion spring 36 does not surround the batteries 44. Applicants' have found that this allows a user to employ larger sizes of batteries 44 than would otherwise be the case. Even more space may be obtained longitudinally by placing torsion spring 36 over or at least partially over motor 28.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A counterbalanced motorized shade system comprising:
- a shade roll extending a length from a first end to a second end, the shade roll having a hollow interior;
- a shade connected to the shade roll;
- a motor located within the hollow interior of the shade roll;
- a drive shaft connected with the motor and the shade roll, the drive shaft positioned within the hollow interior of the shade roll;
- a torsion spring extending a length from a first end to a second end, the torsion spring positioned within the shade roll;
- wherein the torsion spring is operatively connected with the motor on the first end, and the torsion spring is operatively connected with the hollow interior of the shade roll on the second end;
- wherein the torsion spring is positioned around the drive shaft;
- wherein the torsion spring is operably connected on the second end with a drive cone, wherein the drive cone is movable along a length of the hollow interior of the shade roll;
- a plurality of batteries positioned within the hollow interior of the shade roll and electrically connected to the motor;
- wherein the torsion spring is not positioned around the plurality of batteries;
- wherein the motor rotates the drive shaft which rotates the shade roll thereby opening or closing the shade connected to the shade roll; and
- wherein when the motor rotates the drive shaft an end of the torsion spring rotates with the shade roll as an end of the torsion spring remains stationary.

2. The apparatus of claim 1 further including a reduction gear connected with the motor.

3. The apparatus of claim 1 wherein the torsion spring at least partially surrounds the motor.

4. The apparatus of claim 1 wherein the drive shaft is connected with a drive cone connected with the hollow interior.

5. The apparatus of claim 1 wherein the torsion spring is directly connected on one end with a drive cone which is connected with the drive shaft and the shade roll.

6. The apparatus of claim 1 further including a liner positioned in the hollow interior of the shade roll.

7. The apparatus of claim 6 wherein the liner surrounds the torsion spring.

8. The apparatus of claim 6 wherein the torsion spring surrounds the liner.

9. A counterbalanced motorized shade system comprising:
- a shade roll extending a length from a first end to a second end, the shade roll having a hollow interior;
- a shade connected to the shade roll;
- a motor located within the hollow interior of the shade roll;
- a reduction gear connected with the motor;
- a drive shaft connected with the motor and with a drive cone;
- the drive cone connected with the hollow interior of the shade roll;
- a torsion spring extending a length from a first end to a second end, the torsion spring positioned within the shade roll;
- wherein the torsion spring is operatively connected with the motor on the first end, and the torsion spring is operatively connected with the drive shaft on the second end;

wherein the drive cone is movable along a length of the hollow interior of the shade roll;

wherein the torsion spring is positioned around the drive shaft;

a plurality of batteries positioned within the hollow interior of the shade roll opposite from the motors;

wherein the torsion spring does not surround said the plurality of batteries;

wherein the motor rotates the drive shaft which rotates shade roll thereby opening or closing the shade connected to the shade roll; and wherein when the motor rotates the drive shaft an end of the torsion spring rotates with the shade roll as an end of the torsion spring remains stationary.

10. The apparatus of claim 9 wherein the reduction gear is a two stage planetary reduction gear positioned between the motor and the drive shaft.

11. The apparatus of claim 9 wherein the torsion spring at least partially surrounds the motor.

12. The apparatus of claim 9 further including a liner in the hollow interior of the shade roll.

13. The apparatus of claim 12 wherein the liner surrounds the torsion spring.

14. The apparatus of claim 12 wherein the liner includes a first liner that surrounds the torsion spring and a second liner that the torsion spring surrounds such that the torsion spring is located between the first liner and the second liner.

15. A method for using a counterbalanced motorized shade comprising the steps of:

providing a shade roll extending a length from a first end to a second end, the shade roll having a hollow interior;

connecting a shade to the shade roll;

positioning motor within the hollow interior of the shade roll;

positioning a drive shaft within the shade roll;

connecting the drive shaft with the motor and with the shade roll;

position a torsion spring extending a length from a first end to a second end within the shade roll;

connecting the first end of the torsion spring with the motor such that the first end of the torsion spring remains in alignment with the motor;

connecting the second end of the torsion spring with a drive cone, wherein the drive cone is movable along a length of the hollow interior of the shade roll;

positioning the drive cone within the hollow interior of the shade roll;

positioning the torsion spring around the drive shaft;

positioning a plurality of batteries within the hollow interior of the shade roll and electrically connected to the motor;

activating the batteries motor;

rotating the shade roll by the motor; and holding one end of the torsion spring stationary as another end of the torsion spring rotates with the roll tube.

16. The method of claim 15 further including the step of connecting a reduction gear with the motor.

17. The method of claim 15 further including the step of positioning a liner in the hollow interior of the shade roll.

18. The method of claim 15 further including the step of building a counterbalancing force in the torsion spring as one end of the torsion spring rotates.

* * * * *

UNITED STATES PATENT AND TRADEMARK OFFICE

CERTIFICATE OF CORRECTION

PATENT NO. : 8,919,419 B2
APPLICATION NO. : 12/460111
DATED : April 1, 2014
INVENTOR(S) : Willis Jay Mullet et al.

It is certified that error appears in the above-identified patent and that said Letters Patent is hereby corrected as shown below:

In The Specification

Column 9, line 6, delete the word "from";

Column 10, line 1, insert -- a -- after the word positioning;

Column 10, line 6, delete the word "position" and insert the word -- positioning --;

Column 10, line 21, delete the word "batteries".

Signed and Sealed this
Thirty-first Day of March, 2015

Michelle K. Lee

Michelle K. Lee
*Director of the United States Patent and Trademark Office*